United States Patent [19]

Kreft

[11] 4,143,713

[45] Mar. 13, 1979

[54] SELF-CENTERING BASKET

[76] Inventor: Günter Kreft, 5, Hermann-Löns-Weg, D-4520 Melle 1, Fed. Rep. of Germany

[21] Appl. No.: 844,993

[22] Filed: Oct. 25, 1977

[51] Int. Cl.[2] ..... E21B 17/10

[52] U.S. Cl. ..... 166/241

[58] Field of Search ..... 166/138, 139, 140, 166, 166/153, 172, 210, 216, 241; 175/325; 308/4 A

[56] References Cited

U.S. PATENT DOCUMENTS

| | | | |
|---|---|---|---|
| 2,515,149 | 7/1950 | Willhoit | 166/241 |
| 3,055,432 | 9/1962 | Park | 166/172 X |
| 3,209,836 | 10/1965 | Hall | 166/241 |
| 4,042,022 | 8/1977 | Wills et al. | 166/241 |
| 4,077,470 | 3/1978 | Dane | 166/241 X |

*Primary Examiner*—Ernest R. Purser
*Assistant Examiner*—Richard E. Favreau

[57] ABSTRACT

The invention relates to a safety self-centering basket for use during tubing operations on bore holes in the mining industry and in oil fields and the like. The basket has resilient steel bars engaged at their ends with steel rings, the rings being formed from two jointed half shells. The invention is characterized in that the steel bars are held by lugs as a safeguard against them coming out of engagement with the rings. The free end of the lugs is positioned against the outer face of the steel ring.

4 Claims, 9 Drawing Figures

FIG. 2
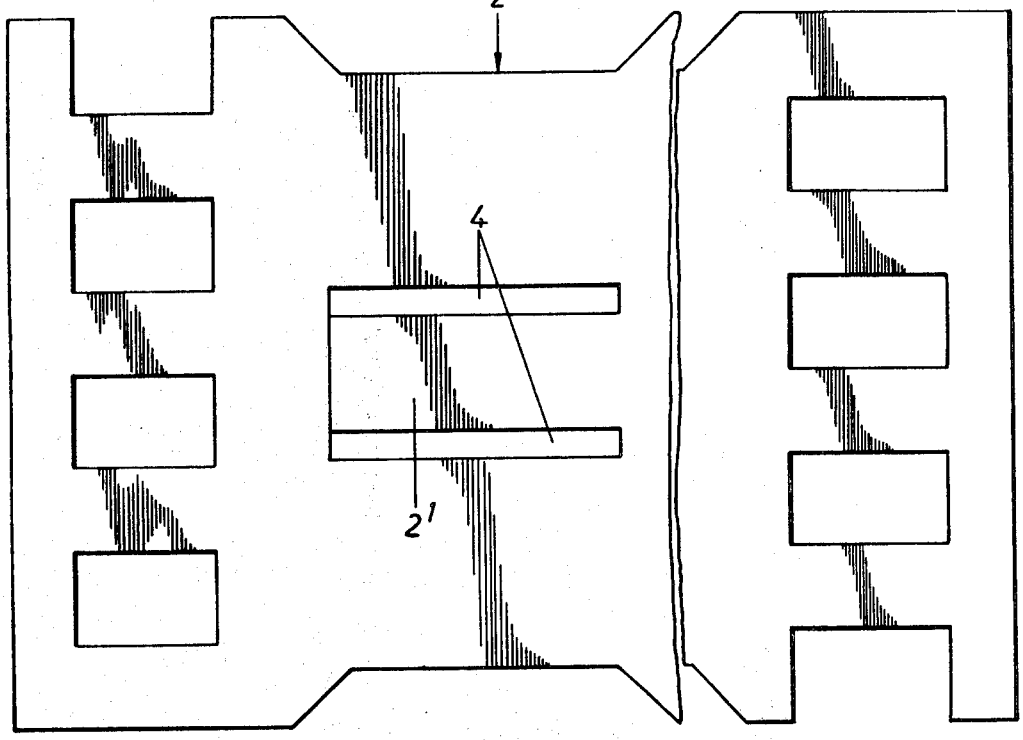
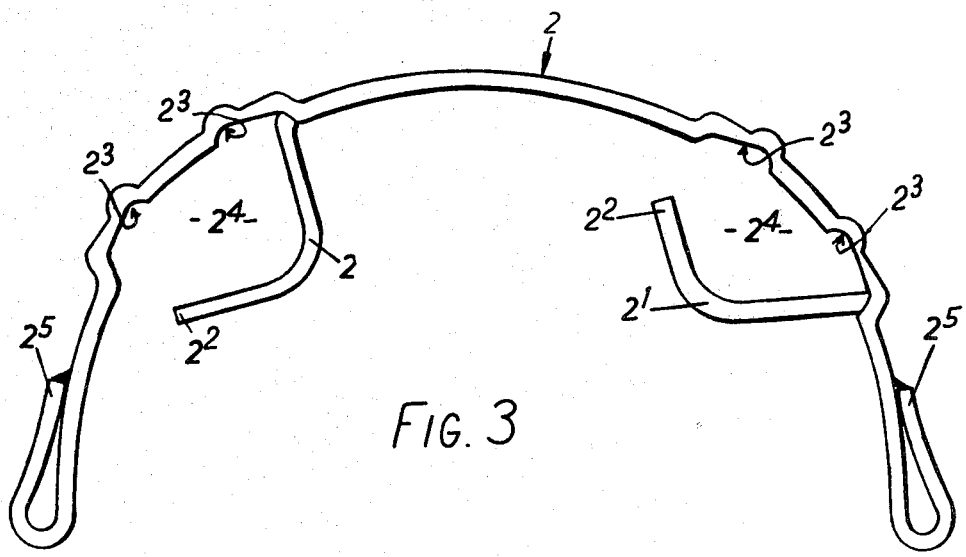
FIG. 3

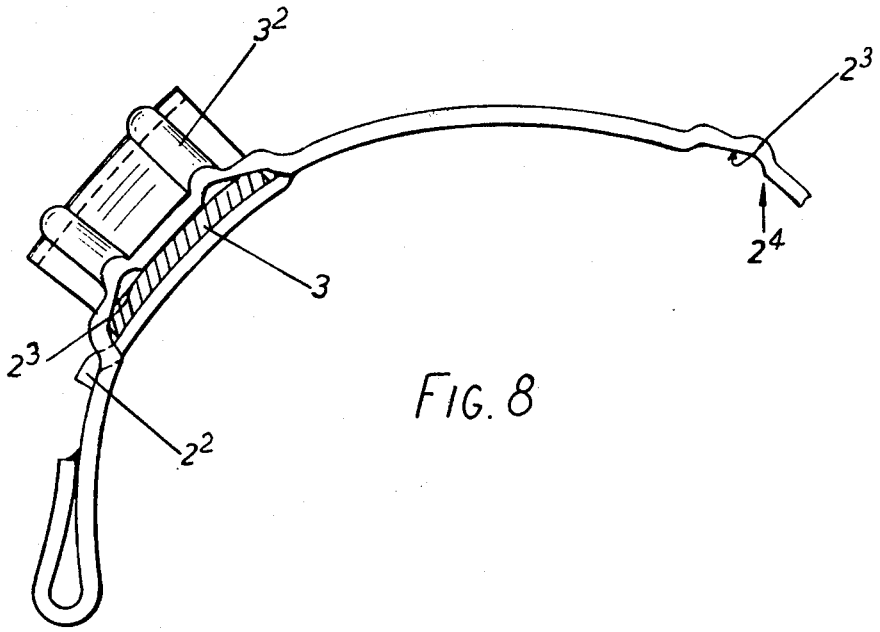
FIG. 8
FIG. 9
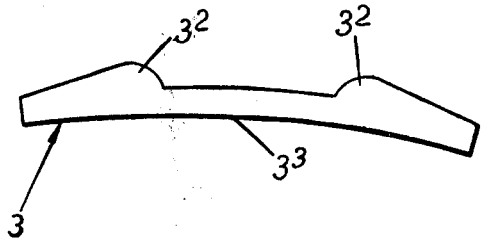

SELF-CENTERING BASKET

The present invention relates to a safety centering basket, for use during tubing operations on bore holes in the mining industry, oil fields and the like, consisting of a number of resilient flat steel bars, which, at their ends, are engaged with steel rings. The steel rings being formed from two jointed half-shells, and the bars are fastened to the rings with the aid of lugs.

Such centering baskets have been part of modern technology for some time. Their main field of application is for supply pipes, which are threaded together to form a pipe length. Centering baskets are placed on these supply pipes, one below the other, at intervals of 20 to 40 meters.

With the aid of these centering baskets a concentric positioning of the threaded pipes is achieved. This feature permits even filling all round of the annular space with cement mud during cementation of the bore holes.

Practice has shown that centering basket bars of known apparatus (see German Patent Specification No. 1,233,345) consisting of high quality steel, and being clamp-fastened, very often jump out of their supports and consequently get stuck in the bore hole. The reason for this is the inadequate fixture of the bars to the basket. During tubing operations the supply pipes are moved in an axial and radial clock-wise direction.

The individual steel bars are subjected to considerable pressure, tension and shattering conditions, because they are in direct contact with the bore hole wall. Due to the considerable friction occurring on the bore hole wall, the steel bars very often get wedged, whereby it becomes impossible to turn back the other way a pipe or the centering basket, especially as the supply pipes would be unthreaded by this operation.

In connection with previously used safety centering baskets, there are known constructions wherein the steel bars are welded on to the steel rings supporting them. These centering baskets cannot be manufactured on an economical basis, and furthermore cannot be taken apart. In addition the known baskets are known for their considerable transport weight.

The object of the invention is to provide a safety centering basket which is not subject to the above-mentioned disadvantages and which does not permit the jumping out of the bars even if subjected to highest stress factors caused during tubing.

With a safety centering basket, for use during tubing operations on bore holes in the mining industry, oil fields or similar, consisting of a number of resilient steel bars which, at their ends, are engaged with steel rings, the steel rings being formed from two jointed half-shells, the bars are fastened to the rings with the aid of lugs. The steel bars are held down by means of lugs in order to prevent them jumping out of engagement, the free ends of the lugs being positioned firmly on the external surfaces of the steel ring.

According to a further feature of the invention, at least two projections are provided for the end of each steel bar and each steel bar has a cut out, into which the lug locks, the steel bars being arched along their whole length with a radius determined by the steel rings.

As an additional advantage, a slot can be provided in the half-shells of the two steel rings above and below the lugs to facilitate pressing out of the lug. The two steel rings of the centering basket provide the same number of lugs as there are on the steel bars.

These inwardly projecting lugs are integral with the half-shells of the steel rings. The hinge knuckles of the half-shells are secured by spot welding.

An embodiment of the invention is described in the following and explained in more detail with the aid of the accompanying drawings, wherein:

FIG. 2 is an enlarged elevational view of a steel half-shell;

FIG. 3 is the steel ring half-shell of FIG. 2 with pressed-out lugs, seen in plan view;

FIG. 8 is an arrangement of a steel bar secured in the half-shell, seen in plan view, and FIG. 9 is a plan view of the steel bar in cross-section.

Figure 1:
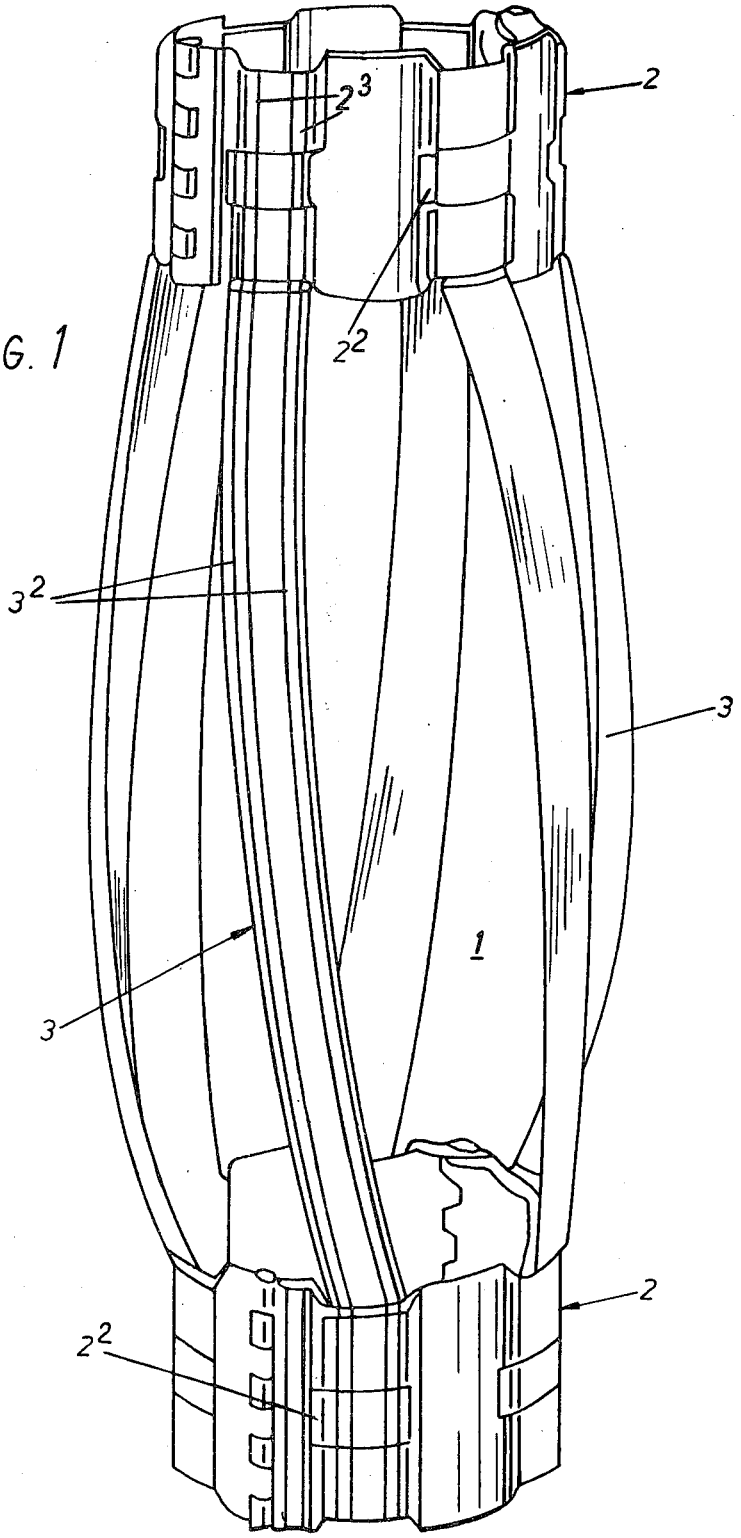
FIG. 1 is a perspective view of a safety centering basket in accordance with the invention.

The safety centering basket shown in FIG. 1 is identified as 1 and consists of a number of resilient steel bars 3 which are each inserted endwise in openings $2^4$ defined by a steel ring 2 formed from two hinged half-shells releasably fastened by lugs $2^1$.

Figure 4:
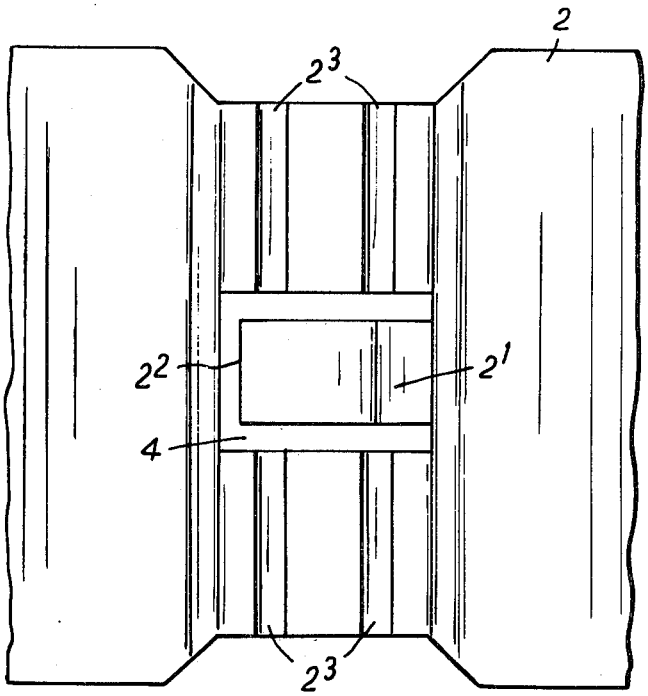
FIG. 4 is a partial elevation of the half-shell with lug seen from the inside.

For this purpose the lugs $2^1$ are extended beyong the openings $2^4$ and are angled off inwardly, as shown in FIG. 3. On the inside adjacent the openings $2^4$ there are placed two spaced recesses $2^3$ which serve to receive the projections $3^2$ of the ends of the steel bar 3. The steel bars 3 are secured in the openings $2^4$ with the aid of the lugs $2^1$ to prevent them from jumping out. Securing of the bar is achieved by pressing the lugs $2^1$ against the inner face $3^3$ of the steel bars 3. For this purpose slots 4 are provided in the wall of the half-shells (see FIGS. 2 and 4).

Figure 5:
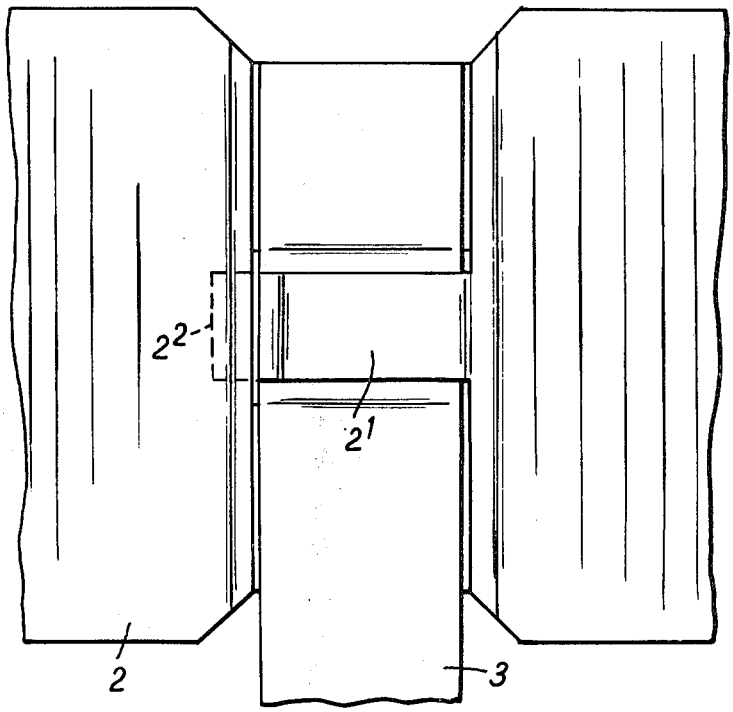
FIG. 5 is an elevation according to FIG. 4, wherein a steel bar is positioned between the half-shell and the pressed out lug.
Figure 6:
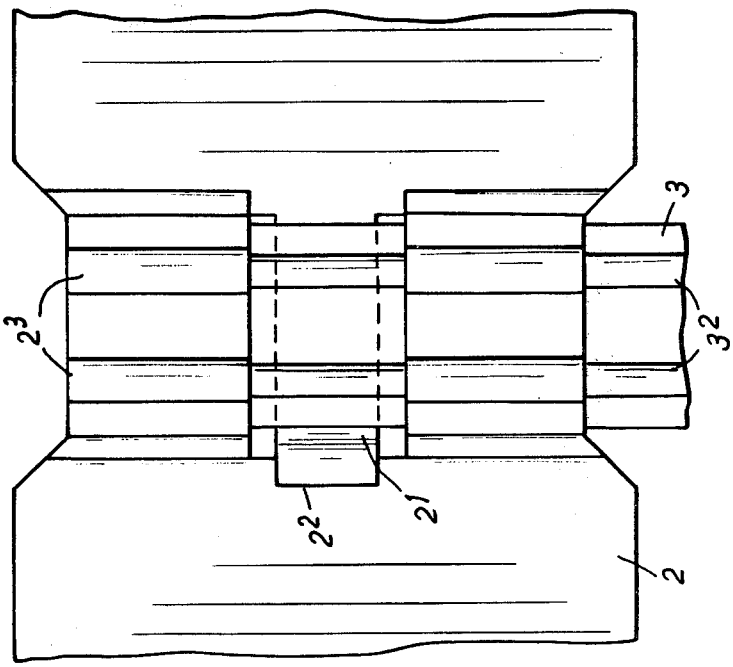
FIG. 6 is a partial elevation of a half-shell with clamped-in steel bar and inserted securing lug, seen from inside.

In order to clamp the steel bar 3, the lug $2^1$ previously displaced inwardly is pushed in the direction of the inserted steel bar 3, whereupon the end $2^2$ of the lug $2^1$ passes through the slot (FIGS. 4 and 5) between steel ring 2 and steel bar 3 and positions itself firmly onto the outer surface of the steel ring 2, as shown in FIG. 6.

Figure 7:
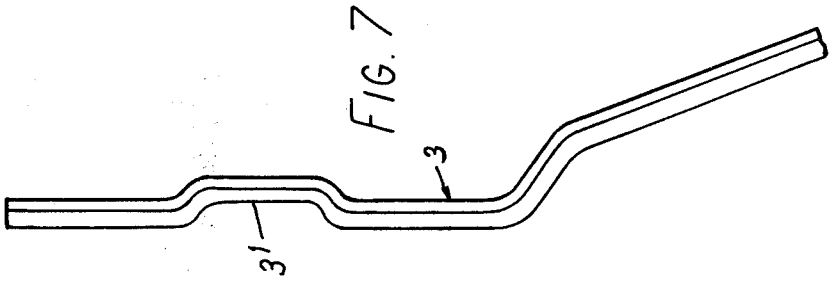
FIG. 7 is a side view of a steel bar.

The projections $3^2$ at the ends of the bars ensure safe positioning of the steel bars 3, and are of a rib-shaped design and are preferably (FIGS. 1 and 7) designed to extend along the whole length of the steel bar 3 in order to ensure stability of the bar, the steel bars 3 being themselves arched along their length with a radius determined by the steel rings 2 (FIGS. 8 and 9).

Cut-outs 3 are provided transversely in the region of the end of each steel bar 3. Into these cut-outs $3^1$ the lugs $2^1$ engage.

Because of the existence of lugs $2^1$ on the steel rings 2 engaged in the cut-outs $3^1$, the recesses $2^3$ and projections $3^2$ and openings $2^4$ and the individual steel bars 3, there is obtained a connection of such strength and stability that jumping out of the bars due to radial and axial forces during tubing operations is made impossible.

Because of the special design and construction of the steel bars 3, the steel bars 3, apart from giving a saving of material of approximately 30%, retain a fixed position in the steel rings 2, so that the shearing forces occurring are distributed across a large area. The hinge knuckles $2^5$ on the steel rings 2 are secured by spot welding operations (FIG. 3). Thus it is possible to use a considerably thinner basic material, so that when compared with previously known centering baskets, in particular compared with those steel rings receiving steel bars, a reduction of material of up to approximately 33% may be obtained. Weak spots at hing knuckles, as have occurred previously with non-welded hinges, are avoided.

A further advantage of the safety centering basket in accordance with this invention resides in the fact that the complete basket can be taken apart without tools, into its individual parts, e.g. for transportation, in the shortest possible time, and then re-assembled at the bore site without any major aids being necessary.

I claim:

1. A safety centering basket, for use on casing in boreholes, comprising:

(i) spaced retaining rings each formed of two half-shells releasably connected together (ii) a plurality of resilient bars disposed in side by side spaced relationship and each engaged at its respective ends with the rings, each half-shell having an internal lug for each bar engaged therewith, each half-shell having recessing on its inner face opposite to each such lug, each resilient bar being convexly shaped along its length and having at least in the region of each end and on its outer face, projection means adapted to engage into the recessing of the half-shell, the lug being passed about the bar and engaged through an opening in the half-shell so as to bear by a free end portion against the outer face of the half-shell, whereby said bars are locked against circumferential movement with respect to the ring by the lug and by the engagement of the projection means in the recessing.

2. A safety centering basket, as claimed in claim 1, wherein each resilient bar has, at a position along its length corresponding to the associated lug, a cut-out disposed across the bar, the associated lug being seated in said cut-out thereby to lock the bar against relative movement with respect to the rings in the axial direction.

3. A safety centering basket, as claimed in claim 1, wherein each lug is an integral portion of the half-shell, and wherein slotting is provided in the half-shell about that integral portion to facilitate deforming of the lug to engage the lug about the bar and cause the end portion of the lug to pass through the slotting and become positioned against the outer face of the half-shell.

4. A safety centering basket, as claimed in claim 1, wherein said half-shells are connected at their ends by hinges, said hinges including hinge knuckles on each half-shell, said hinge knuckles being constituted by portions of said half-shells bent round and secured by spot welding to the outer face of said half-shell.

* * * * *